US012669275B2

(12) United States Patent
Rouhana

(10) Patent No.: US 12,669,275 B2
(45) Date of Patent: Jun. 30, 2026

(54) COLLECTOR AND SEALING PLUG

(71) Applicant: MAHLE International GmbH, Stuttgart (DE)

(72) Inventor: Hicham Rouhana, Korntal-Muenchingen (DE)

(73) Assignee: Mahle International GmbH, Stuttgart (DE)

( * ) Notice: Subject to any disclaimer, the term of this patent is extended or adjusted under 35 U.S.C. 154(b) by 256 days.

(21) Appl. No.: 18/218,343

(22) Filed: Jul. 5, 2023

(65) Prior Publication Data

US 2024/0011684 A1 Jan. 11, 2024

(30) Foreign Application Priority Data

Jul. 6, 2022 (DE) ..... 10 2022 206 913.7

(51) Int. Cl.
*F25B 43/00* (2006.01)

(52) U.S. Cl.
CPC ..... *F25B 43/006* (2013.01)

(58) Field of Classification Search
CPC ..... F25B 43/006; F25B 41/00; F25B 43/00
See application file for complete search history.

(56) References Cited

U.S. PATENT DOCUMENTS 11,313,400 B2 4/2022 Bredbeck et al.
2002/0074335 A1* 6/2002 Ono ..... B60K 15/0406 220/378
2018/0080490 A1* 3/2018 Bredbeck ..... F16B 21/16

FOREIGN PATENT DOCUMENTS

DE 102015205553 A1 * 9/2016
DE 102015007356 A1 10/2016

OTHER PUBLICATIONS

Geiger et al. (DE102015205553A1), English Translation, Container of an air conditioner, 2016, Whole Document (Year: 2016).*

* cited by examiner

*Primary Examiner* — Jerry-Daryl Fletcher
*Assistant Examiner* — Keith Stanley Myers
(74) *Attorney, Agent, or Firm* — Muncy, Geissler, Olds & Lowe, P.C.

(57) ABSTRACT

A collector, in particular a refrigerant collector for a refrigerant circuit, in particular of a motor vehicle, which is formed with a tubular housing body with a circumferential wall and with a first end face and with a second end face, wherein the housing body at the first end face has a closable first opening, into which a sealing plug can be inserted for closing the first opening, wherein the sealing plug has a circumferential groove into which a sealing element can be inserted for sealing between the sealing plug and the circumferential wall, wherein the circumferential groove has a groove bottom, which slopes in the axial direction. A sealing plug is also provided.

10 Claims, 2 Drawing Sheets

COLLECTOR AND SEALING PLUG

This nonprovisional application claims priority under 35 U.S.C. § 119(a) to German Patent Application No. 10 2022 206 913.7, which was filed in Germany on Jul. 6, 2022, and which is herein incorporated by reference.

BACKGROUND OF THE INVENTION

Field of the Invention

The present invention relates to a collector, in particular a refrigerant collector for a refrigerant circuit, in particular for a refrigerant circuit of a motor vehicle. The invention also relates to a sealing plug for a collector.

Description of the Background Art

Collectors, in particular refrigerant collectors for a refrigerant circuit, in particular for a refrigerant circuit of a motor vehicle, are known in the state of the art. Thus, collectors are known which have a tubular housing body which is fixedly and inseparably closed at one end face and which at an opposite end face of the tubular housing body has a closable opening into which a sealing plug can be inserted and secured. In this regard, it is known in the state of the art that the sealing plug is formed of aluminum or plastic and has a body with a substantially cylindrical shape. In this case, the body of the sealing plug has at least two circumferential grooves on the outer circumference which are open in the radial direction and into each of which an O-ring is inserted in order to effect a seal against the inner wall of the housing body when the sealing plug is inserted into the closable opening.

In this regard, the arrangement of the two O-rings serves, on the one hand, to seal the interior of the collector against the penetration of water and dirt from the outside and, on the other hand, to seal against the escape of refrigerant from the inside to the outside.

However, it turns out that the specific space requirement for the seal seat, in particular the outer seal, is relatively high, so that in regard to length the sealing plug must therefore have a certain minimum length, which, however, detrimentally affects the free internal volume of the collector, so that, on the one hand, the material expense for the long sealing plug is increased due to the required overall length of the sealing plug and, on the other hand, the free internal volume that can be used to hold refrigerant is reduced due to the overall length of the sealing plug.

SUMMARY OF THE INVENTION

It is therefore an object of the present invention to provide a collector and a sealing plug which are improved over the prior art and enable a reduced overall length of the sealing plug and permit an increased free internal volume of the collector.

An exemplary embodiment of the invention relates to a collector, in particular a refrigerant collector for a refrigerant circuit, in particular of a motor vehicle, which is formed with a tubular housing body with a circumferential wall and with a first end face and with a second end face, wherein the housing body at the first end face has a closable first opening, into which a sealing plug can be inserted for closing the first opening, wherein the sealing plug has a circumferential groove into which a sealing element can be inserted for sealing between the sealing plug and the circumferential wall, wherein the circumferential groove has a groove bottom, which slopes in the axial direction. This creates a receptacle for the sealing element, which saves installation space compared to the prior art, so that less axial installation space is required overall for the sealing plug and the usable volume range of the collector is increased.

The groove can be defined by a first side wall and a second side wall arranged spaced apart therefrom and by the groove bottom between the two side walls, wherein the first side wall adjoins the deeper end of the groove bottom and the second side wall adjoins the less deep end of the groove bottom. As a result, the groove may be bounded in both axial directions by a side wall extending in the radial direction, so that the position of the sealing element is clearly defined over the service life.

The first side wall can extend radially further inward than the second side wall. As a result, an axial overlap and, if necessary, also a support of the first side wall on one end face of the housing body can take place, which further reduces the penetration of water and dirt.

The first side wall can extend radially further outward than the second side wall, so that the first side wall overlaps the second side wall radially outward. This creates a radially outer larger spatial area for the sealing element, wherein the sealing element is compressed more greatly axially inward, which improves the sealing effect.

The first side wall can lie axially further outward than the second side wall and/or that the slope of the groove bottom is axially outward. This also creates a radially outer larger spatial area for the sealing element, wherein the sealing element is compressed more greatly axially inward, which improves the sealing effect.

The first end face of the housing body can have an annular region, sloping in the axial direction, on an inwardly facing side. This also decreases the spatial area for the sealing element axially inward, which improves the sealing effect.

The annular region sloping in the axial direction can slope further outward axially. This also increases the spatial area for the sealing element axially outward, which improves the sealing effect axially inward and reduces the spatial area required for sealing.

The annular region sloping in the axial direction together with the grove bottom, sloping in the axial direction, can form an annular region, which is trapezoidal or triangular in cross section, for receiving the sealing element. In particular, this increases the spatial area for the sealing element axially outward and reduces it axially inward, which improves the sealing effect axially inward and reduces the spatial area required for sealing overall.

The sealing element can be an O-ring. Alternatively, the sealing element can also be an annular element, which has an oval or angular cross section.

An exemplary embodiment of the invention relates to a sealing plug for use with a collector according to the above statements, wherein the sealing plug has a base body, wherein the sealing plug has a circumferential groove into which a sealing element can be inserted for sealing between the sealing plug and a circumferential wall of the collector, wherein the circumferential groove has a groove bottom, which slopes in the axial direction. This creates a receptacle for the sealing element, which saves installation space compared to the prior art, so that less axial installation space is required overall for the sealing plug and the usable volume range of the collector is increased. The sealing plug is used to be inserted into a closable first opening of the collector in order to close the first opening.

The groove can be defined by a first side wall and a second side wall arranged spaced apart therefrom and by the groove bottom between the two side walls, wherein the first side wall adjoins the deeper end of the groove bottom and the second side wall adjoins the less deep end of the groove bottom. As a result, the groove is bounded in both axial directions by a side wall extending in the radial direction, so that the position of the sealing element is clearly defined over the service life.

The first side wall can extend radially further inward than the second side wall. As a result, an axial overlap and, if necessary, also a support of the first side wall on one end face of the housing body can take place, which further reduces the penetration of water and dirt.

The first side wall can extend radially further outward than the second side wall, so that the first side wall overlaps the second side wall radially outward. This creates a radially outer larger spatial area for the sealing element, wherein the sealing element is compressed more greatly axially inward, which improves the sealing effect.

The first side wall can lie axially further outward than the second side wall and/or that the slope of the groove bottom is axially outward. This also creates a radially outer larger spatial area for the sealing element, wherein the sealing element is compressed more greatly axially inward, which improves the sealing effect.

The sealing element can be an O-ring. Alternatively, the sealing element can also be an annular element, which has an oval or angular cross section.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
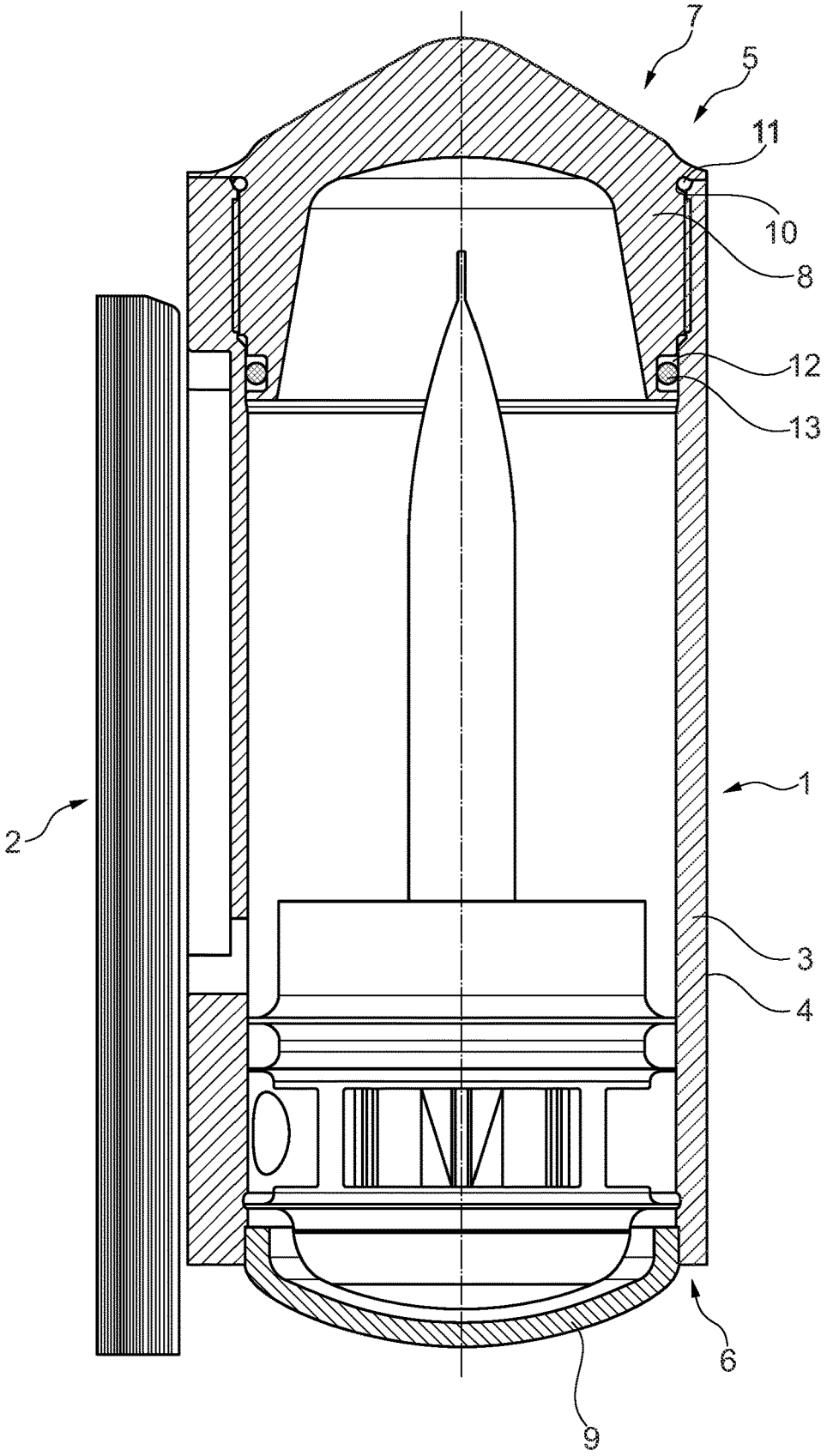
FIG. 1 shows a schematic sectional view of an example of a collector of the invention with a sealing plug.

FIG. 1 shows in a very schematic representation a collector 1 and a condenser 2, which are disposed in a refrigerant circuit of a motor vehicle. In this case, collector 1 is arranged adjacent to condenser 2 and is fluidly connected to it.

In the exemplary embodiment shown, collector 1 is a refrigerant collector. Collector 1 is fluidly connected to condenser 2 via fluid connections which are not shown.

Condenser 2 is shown in FIG. 1 formed as a stacked plate condenser, wherein it can alternatively be formed in another way, for example, by means of a tube and fin block and with a collecting tube on one side of the tube and fin block or with collecting tubes on both sides of the tube and fin block.

Collector 1, in particular, the refrigerant collector for a refrigerant circuit, in particular of a motor vehicle, is formed with a tubular housing body 3. Housing body 3 is formed, for example, as a tube section. In this case, housing body 3 has a circumferential wall 4 with a first end face 5 and with a second end face 6.

For example, tubular housing body 3 is designed so that at first end face 5 it has a closable first opening 7 into which a sealing plug 8 can be inserted for closing first opening 7.

At second end face 6, tubular housing body 3 can be closed, for example, in one piece or closed with a fixedly connected cover 9. Cover 9 can be caulked, soldered, welded, glued, or screwed, etc., to tubular housing body 3.

The one-piece design of tubular housing body 3 with the closed closure at second end face 6 can also be achieved by deep drawing or the like.

If tubular housing body 3 is made of plastic, injection molding, etc., of housing body 3 can also be carried out.

In principle, tubular housing body 3 and/or cover 9 can be made of metal or plastic.

Sealing plug 8 can also be fabricated of plastic or metal, for example, aluminum.

Sealing plug 8 has a first circumferential groove 10 into which a first sealing element 11 can be inserted for sealing between sealing plug 8 and circumferential wall 4.

Sealing plug 8 optionally has a second circumferential groove 12 into which optionally a second sealing element 13 can be inserted for sealing between sealing plug 8 and circumferential wall 4.

First groove 10 is arranged at a first axial end region of closure plug 8, and the optional second groove 12 is optionally arranged at a second axial end region of sealing plug 8.

If sealing plug 8 is inserted into opening 7, first sealing element 11 is arranged axially further outward than the optional second sealing element 13, as can be seen in FIG. 1.

Figure 3:
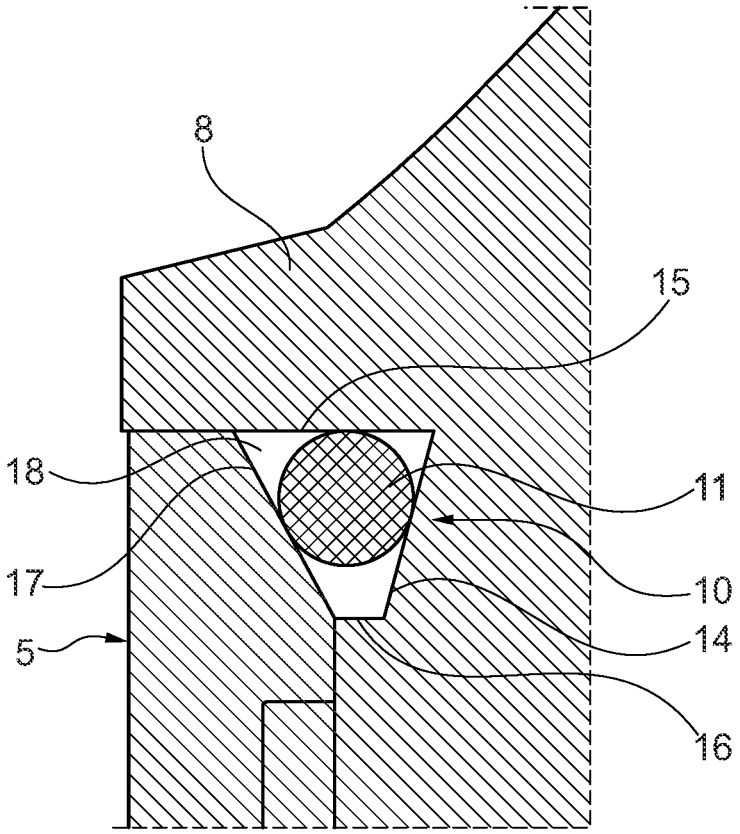
FIG. 3 shows a further schematic partial sectional view of the collector of the invention with a sealing plug.

First circumferential groove 10 has a groove bottom 14, see FIG. 3, which slopes in the axial direction. Thus, groove 10 is formed with different depths when viewed in the axial direction.

Circumferential groove 10 is defined by a first side wall 15, a second side wall 16 spaced apart therefrom, and by groove bottom 14 between the two side walls 15, 16. Groove 10 is formed outwardly open in the radial direction.

First side wall 15 adjoins the deeper end of groove bottom 14 and second side wall 16 adjoins the less deep end of groove bottom 14. First side wall 15 extends correspondingly radially further inward than second side wall 16.

Sealing element 11 is inserted into groove 10; as an elastic element, it is larger than groove 10 when not acted upon, as also shown in FIG. 3. If sealing element 11 is inserted into groove 10, it adapts to the contour of groove 10.

First side wall 15 extends radially further outward than second side wall 16, so that first side wall 15 overlaps second side wall 16 radially outward.

Figure 2:
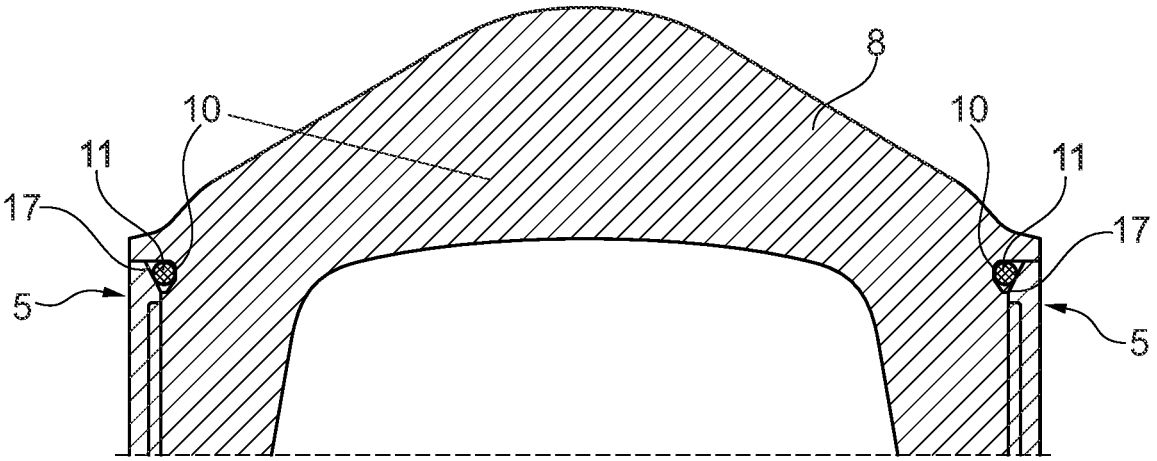
FIG. 2 shows a schematic partial sectional view of the collector of the invention with a sealing plug.

According to FIGS. 2 and 3, first side wall 15 is located axially further outward than second side wall 16 and/or the slope of groove bottom 14 occurs axially outward.

Furthermore, FIGS. 2 and 3 also show that first end face 5 of housing body 3 has an annular region 17, sloping in the axial direction, on an inwardly facing side. In this case, annular region 17, which slopes in the axial direction, slopes axially further outward. In this case, annular region 17 slopes in the same direction as groove bottom 14.

Thus, annular region 17, sloping in the axial direction, together with groove bottom 14, sloping in the axial direction, can form an annular region 18, which is trapezoidal or triangular in cross section, for receiving sealing element 11.

In this regard, sealing element 11 can be, for example, an O-ring or a ring of another design, for example, with an oval or angular cross section. Advantageously, sealing element 11 is made of an elastomer, for example, of rubber, etc.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A collector, the collector being a refrigerant collector for a refrigerant circuit of a motor vehicle, the collector comprising:

a tubular housing body with a circumferential wall and with a first end face and with a second end face;

a closable first opening arranged on the housing body at the first end face; and a sealing plug that is inserted into the first opening for closing the first opening, wherein the sealing plug has a circumferential groove into which a sealing element is adapted to be inserted for sealing between the sealing plug and the circumferential wall, the circumferential groove having a groove bottom that slopes in an axial direction, wherein the groove is defined by a first side wall and a second side wall arranged spaced apart therefrom and by the groove bottom between the first and second side walls, wherein the first side wall adjoins a deeper end of the groove bottom and the second side wall adjoins a less deep end of the groove bottom, wherein an inwardly facing side of the first end face of the housing body has an annular region, the annular region being a surface that slopes in the axial direction, and wherein, in a fully inserted state of the sealing plug in the first opening of the housing body, an upper edge of the surface of the housing body that slopes in the axial direction contacts the first side wall of the groove at a point that is between a radially inner edge of the first side wall and a radially outer edge of the first side wall, and wherein the first side wall continuously faces a same direction perpendicular to the first side wall, from the radially inner edge to the radially outer edge.

2. The collector according to claim 1, wherein the first side wall extends radially further inward than the second side wall.

3. The collector according to claim 1, wherein the first side wall extends radially further outward than the second side wall so that the first side wall overlaps the second side wall radially outward.

4. The collector according to claim 1, wherein the groove bottom slopes axially outward from the first side wall to the second side wall.

5. The collector according to claim 1, wherein the annular region that slopes in the axial direction slopes outward axially in a direction from the second side wall of the groove towards the first side wall.

6. The collector according to claim 1, wherein a region enclosed by the annular region of the first end face of the housing body, the groove bottom and the first and second side walls of the groove is trapezoidal or triangular in cross section and receives the sealing element.

7. The collector according to claim 1, wherein the sealing element is an O-ring.

8. The sealing plug for the collector according to claim 1, wherein the sealing plug has a base body, wherein the sealing plug has the circumferential groove into which the sealing element is adapted to be inserted for sealing between the sealing plug and the circumferential wall of the collector, and wherein the circumferential groove has the groove bottom, which slopes in the axial direction.

9. The collector according to claim 1, wherein, in the fully inserted state of the sealing plug in the first opening of the housing body, a lower edge of the surface of the housing body that slopes in the axial direction contacts a radially outer edge of the second side wall of the groove.

10. The collector according to claim 1, wherein the sealing element contacts the groove bottom of the sealing plug when the sealing element is inserted in the groove.

* * * * *